United States Patent [19]

Reiswig

[11] Patent Number: 5,065,513

[45] Date of Patent: Nov. 19, 1991

[54] ARTIFICIAL FINGERNAIL CLIPPER

[76] Inventor: Gary J. Reiswig, 17190 SW. 131st, Tigard, Oreg. 97224

[21] Appl. No.: 585,484

[22] Filed: Sep. 20, 1990

[51] Int. Cl.[5] ..... A45D 29/02

[52] U.S. Cl. ..... 30/29; 30/241

[58] Field of Search ..... 30/26, 27, 28, 29, 241; 132/75.5

[56] References Cited

U.S. PATENT DOCUMENTS

| | | | |
|---|---|---|---|
| 54,966 | 5/1866 | Schwartz . | |
| 165,402 | 7/1875 | Bates . | |
| 205,088 | 6/1878 | Hollman . | |
| 1,347,651 | 7/1920 | Nauth . | |
| 1,927,234 | 9/1933 | Hawkins | 30/184 X |
| 2,540,782 | 2/1951 | Hansen | 30/27 |
| 2,629,927 | 3/1953 | Hartwell | 30/241 |
| 2,955,354 | 10/1960 | Laing . | |
| 3,838,507 | 7/1974 | Clark | 30/29 |
| 4,228,585 | 10/1980 | Nelson | 30/29 |
| 4,856,190 | 8/1989 | Reiswig | 30/29 |

FOREIGN PATENT DOCUMENTS 582902 8/1933 Fed. Rep. of Germany .

*Primary Examiner*—Frank T. Yost
*Assistant Examiner*—Rinaldi Rada
*Attorney, Agent, or Firm*—Kolisch, Hartwell, Dickinson, McCormack & Heuser

[57] ABSTRACT

An artificial fingernail clipper is provided which includes a stationary nail holder with an aperture therein for receiving the fingernail, a cutting blade slidably disposed against and above the nail holder, and a blade mounting member which extends past the cutting blade and secured in the nail holder. An operating handle is disposed rearwardly of the cutting end having a pivotable member pivotally mounted with respect to and in direct contact with the cutting blade. The pivotable member thus causes the cutting blade to be slid forwardly to effect cutting of the nail. Pivoting of the pivotable member tends to exert an upward force on the rear end of the cutting blade, thereby ensuring that the forward edge of the cutting blade is in close contact with the nail holder, to ensure a clean cut.

9 Claims, 1 Drawing Sheet

ARTIFICIAL FINGERNAIL CLIPPER

BACKGROUND OF THE INVENTION

The present invention relates generally to fingernail clippers and more particularly to clippers for artificial fingernails.

Artificial nails can be attached to natural fingernails to provide the appearance of long natural fingernails. Artificial nails are typically composed of elongate plastic material having a crescent-shaped cross section similar to a natural nail but much thicker. Artificial nails are thus far less likely to split or break. To mount artificial nails in place, they are first attached to the natural nail and then clipped to a desired length with a series of lateral cuts across the nail to form a rough outline of the desired curvature. The roughened edge is then filed to a smooth, continuous curvature, and is then buffed. In the filing and buffing step, plastic dust is introduced into the work area. This dust can adhere to any previously applied but wet fingernail polish, and thus can complicate the preparation process.

To overcome some of the problems inherent in the above-described process, I developed a single cut clipper for artificial nails, and was granted U.S. Pat. No. 4,856,190. That patent describes a nail clipper having a nail holder with a crescent-shaped aperture to receive an artificial fingernail, and has a straight edged blade slidably mounted in face-to-face relation to the nail holder. As the blade of the clipper is actuated, its edge is driven across the aperture to sever the artificial nail and form with one stroke a cut of desired continuous curvature controlled by suitable orientation of the clipper as the nail is clipped.

While my previously patented single cut clipper has been successful and has been widely adopted by artificial fingernail users, the design of this earlier clipper is somewhat complicated and is therefore more expensive than perhaps desirable. Another potential drawback with my prior clipper is that it includes a link which exerts a forward and downward force o the cutting blade as the blade is actuated. This downward force presses the rear end of the blade against the nail holder, and may tend to cause the cutting blade to slightly tilt away from the nail holder at the cutting edge of the blade, thereby presenting the possibility of a less-than-precise cut.

Accordingly, it is an object of the present invention to provide a fingernail clipper which overcomes the drawbacks and limitations of the prior art proposals. More specifically, the invention has as its objects the following: (1) to develop a fingernail clipper which is more simple and therefore less expensive than clippers now available; (2) to provide a clipper having a blade which is activated in a motion which increases the accuracy or effectiveness of the cut; (3) the provision of a reciprocating blade fingernail clipper requiring a minimum of linkage to slide the blade; (4) to provide a clipper which clips an artificial nail to its final shape with a single cut and with selective curvature to thereby minimize the filing required and plastic dust generated during the cutting process; (5) to develop a fingernail clipper in which one of the handles directly engages the blade to produce a reciprocating action by the blade; and (6) to develop a reciprocating blade fingernail clipper in which the blade may be easily removed for repair or replacement.

SUMMARY OF THE INVENTION

The objects of the invention are achieved by the provision of a fingernail clipper which includes a cutting end having a stationary nail holder with an aperture therein for receiving a fingernail, a cutting blade slidably disposed against and above the nail holder, and a blade mounting member which extends past the cutting blade and is secured to the nail holder. Also included is an operating handle disposed rearwardly of the cutting end having a pivotable member pivotally mounted with respect to and in direct contact with the cutting blade to cause the cutting blade to extend to effect cutting of the nail, such that pivoting of the pivotable member tends to exert an upward force on the rear end of the cutting blade, causing a downward pressure by the cutting edge against the nail holder. In a preferred embodiment, the disposition of the pivotable member is such that the upward force increases as the pivoting of the pivotable member and the extension of the cutting blade continue. This causes a clean cut to be effected in any nail which is positioned within the nail holder aperture.

After repeated use of the clipper, the cutting edge of the blade may become dull and require repair or replacement. In one embodiment of the present invention, the nail holder is detachably mounted and by pivoting the pivotable member to a fully pivoted position the cutting blade may be removed from the clipper once the blade mounting member is removed.

These and other objects and advantages of the present invention will become more fully apparent as the description which follows is read in conjunction with the drawings.

DETAILED DESCRIPTION OF THE PREFERRED EMBODIMENT

Figure 1:
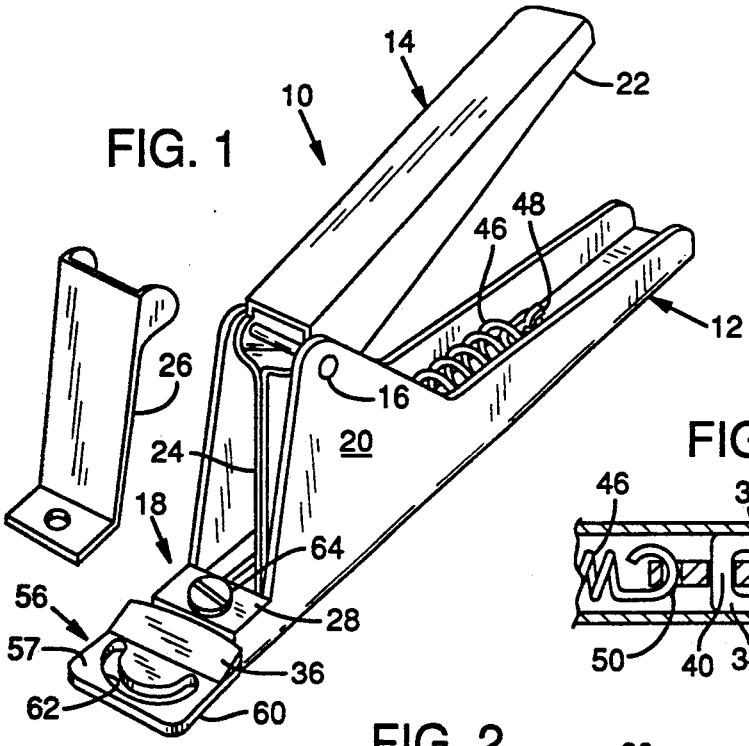
FIG. 1 is a partially exploded perspective view of a preferred embodiment of the present invention.

A preferred embodiment of the present invention has been depicted in the drawings and is generally indicated at 10. The depicted fingernail clipper 10 can be used for natural fingernails, but is particularly adapted to be used with artificial nails. It includes an operating mechanism having a stationary member or handle 12 and a pivotable member or handle 14 which is pivotally mounted to the stationary handle at a pivot joint 16. The stationary handle 12 extends rearwardly from a cutting end 18 of the clipper and includes a pivot bracket 20 to which pivot joint 16 is mounted. The pivotable handle 14 includes a first portion 22 which extends away from cutting end 18, and a second portion 24. The pivot joint 16 is disposed between these two portions of the pivotable handle 14. A cover plate 26 (see FIG. 1) is mounted over the forward end of stationary handle 12 adjacent the two sides of pivot bracket 20. The forward end of stationary handle 12 includes an integral blade mounting plate 28 which, in combination with the underside of the stationary handle and a dimple-ridge 30 therein, defines a rectangular blade mounting channel.

Figure 5:
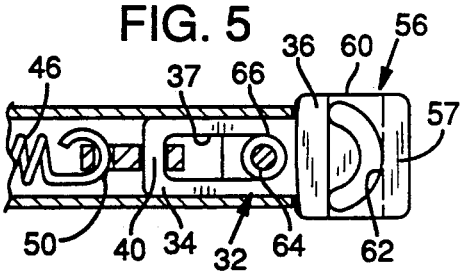
FIG. 5 is a fragmentary top plan sectional view taken along line 5—5 of FIG. 3.
Figure 2:
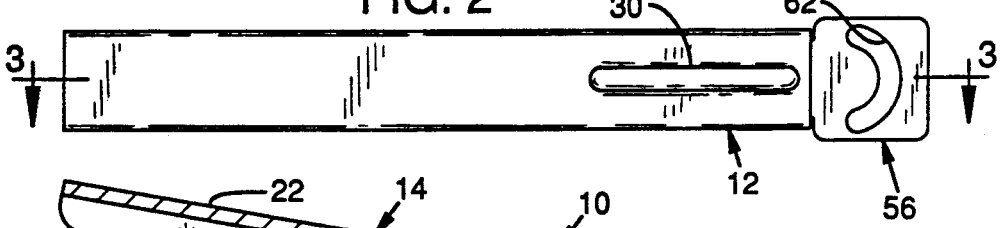
FIG. 2 is a plan view from the underside of the embodiment of FIG. 1.
Figure 3:
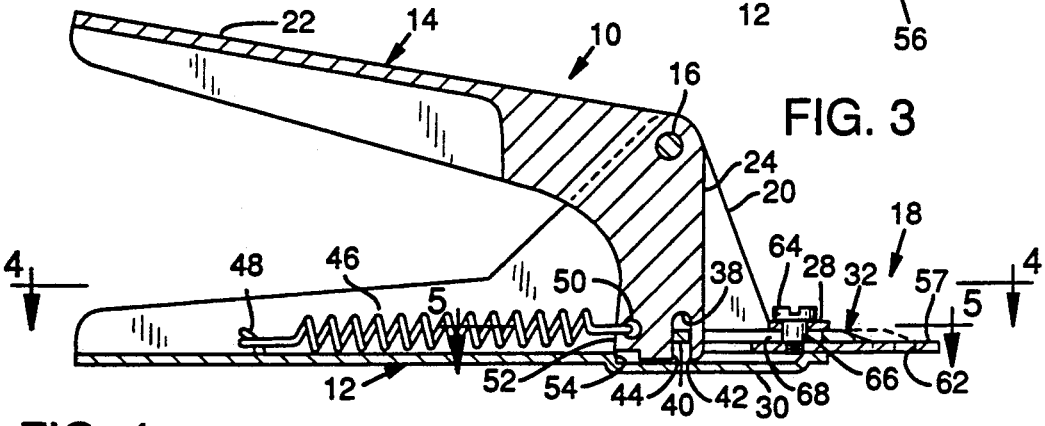
FIG. 3 is a side elevation sectional view taken along line 3—3 of FIG. 2, with the cover plate deleted for illustration purposes.
Figure 4:
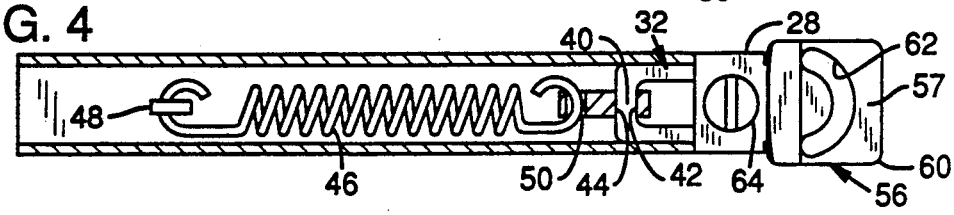
FIG. 4 is a top plan sectional view taken along line 4—4 of FIG. 3.

Disposed within the blade mounting channel is a generally planar cutting blade 32 having a rear end 34 and a cutting end or edge 36. The cutting edge is sharpened by beveling and is typically a straight edge extending normal to the direction of reciprocation of the cutting blade. As shown best in FIG. 5, all but the portion of the cutting blade adjacent the cutting edge 36 fits within the blade mounting channel. The fit of the cutting blade within the blade mounting channel is such that the cutting blade can slide therein. The cutting blade also includes a longitudinally extending slot 37, as shown in FIGS. 4 and 5. The rear end 34 of cutting blade 32 is engaged by the downwardly extending second portion 24 of pivotable handle 14, as shown best in FIGS. 3 and 5.

In the depicted embodiment, the second portion of the pivotable handle includes a notch 38 which engages a laterally extending portion 40 of the rear end 34 of cutting blade 32. The notch 38 provides a pulling edge 42 and a pushing edge 44 which are designed to pull and push cutting blade 32, respectively. A biasing spring 46 extends from a rearward portion of stationary handle 12 at 48 and is mounted to pivotable handle 14 at an aperture 50 in the second portion 24 thereof. A rearward end 52 (see FIG. 3) of the second portion 24 of pivotable handle 14 is designed to contact the underside of the stationary handle at 54 so that biasing spring 46 holds the pivotable handle against the stationary handle at this point.

Also mounted to the cutting end of clipper 10 is a stationary nail holder 56 which has an upper surface 57. The nail holder includes a rear portion 58 disposed within the blade mounting channel, and an enlarged forward portion 60 which extends forwardly beyond the blade mounting channel. A crescent-shaped aperture 62 is defined within the enlarged portion 60 of nail holder 56 and is designed to receive the artificial fingernail (not shown) which is to be cut.

A screw 64 having a downwardly extending shoulder 66 extends through blade mounting plate 28 and the slot 37 in cutting blade 32, and is threaded into nail holder 56. Screw 64 thus maintains the position of nail holder 56 while providing a reciprocation channel 68 through which cutting blade 32 is designed to slide.

Operation of the Depicted Embodiment

To use the depicted clipper 10, the user extends her fingernail through the underside of the aperture 62 in nail holder 56. The nail may be positioned to effect the desired cut angulation as described and depicted in my aforementioned patent. The pivotable handle 14 is then pressed downward in a cutting direction toward the stationary handle 12 against the biasing of spring 46 to cut the nail. Cutting is effected as the pushing edge 44 of the second portion 24 of pivotable handle 14 pushes against the laterally extending portion 40 of the rear end 34 of cutting blade 32 to cause the cutting blade to slide forwardly in reciprocation channel 68 so that the cutting edge 36 slices through the fingernail disposed in aperture 62. Because the second portion 24 of pivotable handle 14 is disposed generally perpendicular to cutting blade 32 as depicted in FIG. 3 in its resting position, and because pivot joint 16 is disposed above the cutting blade, actuation of the pivotable handle 14 in a counterclockwise direction tends to exert upward pressure on the rear end of cutting blade 32 as it is being forwardly pushed through reciprocation channel 68. This upward pressure on the rear end of the cutting blade increases as pivoting continues and as the angulation between the pushing edge 44 and the rear end of the cutting blade increases. This pressure tends to cause the cutting blade to tilt slightly forwardly and downwardly, thereby ensuring that the cutting end 36 is tightly pressed against the nail holder 56 as cutting is being effected. This results in a very clean cut.

After the cut has been effected, the user can relax her hand, and biasing spring 46 will cause retraction of the second portion 24 of pivotable handle 14 which results in pulling edge 42 pulling against the laterally extending portion 40 of the cutting blade to cause retraction thereof back to the initial at rest position depicted in FIG. 3.

The cutting blade 32 may be removed from clipper 10 for replacement or repair by withdrawing screw 64. This permits cutting blade 32 to be slid forwardly out of the clipper once pivotable handle 14 is in its fully pivoted position (not shown). The blade may be replaced by merely sliding it back into the clipper, permitting the biasing spring to bias the pivotable handle to its original position, and then replacing the screw. The shoulder 66 in screw 64 prevents nail holder 56 from being tightened further than is desirable.

The depicted embodiment thus provides clipper which is easy to use, which is simple in construction and therefore inexpensive to fabricate, and yet which permits a clean cut to be effected every time it is used. Blade replacement is easy and can be done by the user with little or no instruction.

Although a preferred embodiment of the invention has been disclosed, it should be appreciated that variations and modifications ma be made thereto without departing from the scope of the invention, as defined in the appended claims.

What we claim is:

1. A fingernail clipper comprising:

a cutting end including a stationary nail holder having an aperture therein for receiving a fingernail, a cutting blade slidably disposed against and above the nail holder, the cutting blade having a rear end and a cutting edge, and a blade mounting member which extends past the cutting blade and is secured to the nail holder; and an operating mechanism including a stationary handle extending rearwardly from the cutting end and a pivotable handle pivotally mounted to the stationary handle, the pivotable handle having a pushing edge in direct contact with the cutting blade such that upon pivoting of the pivotable handle in a cutting direction, the pushing edge urges the cutting blade forward over the aperture in the nail holder to effect cutting of the fingernail, an upward force being exerted on the rear end of the cutting blade by the pivotable handle upon pivoting the pivotable handle in the cutting direction, the force increasing as the pivotable handle pivots in the cutting direction.

2. A fingernail clipper comprising:

a cutting end including a stationary nail holder having an upper surface and an aperture extending through the hail holder for receiving a fingernail, a cutting blade slidably disposed against the upper surface of the nail holder, the cutting blade having a rear end and a cutting edge, and a blade mounting member which extends past the cutting blade and is secured to the nail holder; and an operating mechanism including a stationary handle fixedly mounted to and extending rearwardly from the nail holder, a pivotable handle pivotally connected to the stationary handle and directly engaging the rear end of the cutting blade, and a biasing member extending between the stationary and pivotable handles to bias the pivotable handle toward a resting position wherein the pivotable handle maintains the cutting blade in a fully retracted position, the pivoting of the pivotable handle against the biasing of the biasing member exerting an upward force on the rear end of the cutting blade to cause the cutting edge of the cutting blade to press against the upper surface of the nail holder as the blade is slid forwardly to effect cutting of the fingernail.

3. The clipper of claim 2 further comprising a mounting plate in spaced relation to the nail holder, the combination of the mounting plate and the nail holder defining a reciprocation channel through which the cutting blade slides, the cutting blade being pivotally disposed against the mounting plate during forward sliding movement of the cutting blade, the pivotable handle engaging the rear end of the cutting blade rearward of the reciprocation channel during the entire range of forward sliding movement of the cutting blade.

4. A clipper for the cutting of a fingernail, the clipper comprising:

a nail holder including an upper surface, the holder defining an aperture through which the fingernail may extend;

a cutting blade including a rear end and a cutting edge, the blade being slidably disposed against the upper surface of the nail holder to effect cutting of the fingernail upon passage of the cutting edge over the aperture in the nail holder;

a stationary handle rigidly secured to and extending rearwardly from the nail holder, the stationary handle including a mounting plate in spaced relation to the upper surface of the nail holder, the mounting plate and nail holder combining to define a reciprocation channel through which the cutting blade slides; and a pivotable handle pivotally mounted directly to the stationary handle to provide for pivotal movement of the pivotable handle in a cutting direction, the pivotable handle including a pushing edge which directly engages the rear end of the cutting blade to urge the same forward through the reciprocation channel upon pivoting of the pivotable handle in the cutting direction, the pushing edge of the pivotable handle exerting an upward force on the rear end of the blade when the cutting blade is urged forward.

5. The clipper of claim 4 wherein the cutting blade is pivotal about the mounting plate, the cutting edge of the blade tightly engaging the upper surface of the nail holder upon exerting an upward force on the rear end of the blade.

6. The clipper of claim 4 wherein the pushing edge of the pivotable handle is a planar surface, the pushing edge contacting the rear end of the cutting blade from below to exert a direct upward force on the rear end of the blade during the entire range of movement of the pivotable handle in the cutting direction.

7. The clipper of claim 4 further comprising a removable blade mounting member which extends between the mounting plate and the nail holder to define a path along which the cutting blade moves.

8. The clipper of claim 7 wherein the cutting blade defines a slot through which the mounting member passes, movement of the blade being directed by the slot.

9. The clipper of claim 10 further comprising a biasing member extending between the stationary and pivotable handles, the biasing member biasing the pivotable handle against pivotal motion in the cutting direction.

* * * * *